US011454445B2

(12) United States Patent
Celebre et al.

(10) Patent No.: US 11,454,445 B2
(45) Date of Patent: Sep. 27, 2022

(54) SWIVELING SANDING SYSTEM

(71) Applicant: Celebre 2000 Inc., Bolton (CA)

(72) Inventors: Claudio Celebre, Bolton (CA); Harpreet Singh, Bolton (CA)

(73) Assignee: Celebre 2000 Inc., Ontario (CA)

( * ) Notice: Subject to any disclaimer, the term of this patent is extended or adjusted under 35 U.S.C. 154(b) by 194 days.

(21) Appl. No.: 16/540,252

(22) Filed: Aug. 14, 2019

(65) Prior Publication Data

US 2021/0048250 A1 Feb. 18, 2021

(51) Int. Cl.

| | |
|---|---|
| ***F27D 3/15*** | (2006.01) |
| ***C21D 7/12*** | (2006.01) |
| ***C21B 7/12*** | (2006.01) |

(52) U.S. Cl.

CPC ..... *F27D 3/1536* (2013.01); *C21B 7/12* (2013.01); *F27D 3/1518* (2013.01)

(58) Field of Classification Search

CPC ..... C21B 7/12; F27D 3/1518; F27D 3/1536
USPC ..... 266/45, 100, 272, 44, 271, 273
See application file for complete search history.

(56) References Cited

U.S. PATENT DOCUMENTS

| | | | | |
|---|---|---|---|---|
| 3,943,669 A | | 3/1976 | Stroezel | |
| 4,715,585 A | * | 12/1987 | Simko | C21C 5/4653 264/30 |
| 9,052,144 B2 | * | 6/2015 | Kephart | F27D 3/1536 |
| 9,920,995 B2 | | 3/2018 | Longo | |

FOREIGN PATENT DOCUMENTS

| | | | | |
|---|---|---|---|---|
| JP | H074852 | * | 1/1995 | F27D 3/1536 |
| KR | 20130122112 | * | 11/2013 | F27D 3/1536 |

* cited by examiner

*Primary Examiner* — Jessee R Roe
*Assistant Examiner* — Michael Aboagye
(74) *Attorney, Agent, or Firm* — The Webb Law Firm

(57) ABSTRACT

The present invention relates to delivering sand to a metal melting furnace to fill a tap hole. The swiveling sander moves into position through a horizontal arcing movement. The Swiveling Sanding Systems comprises a swiveling sander with slag plunger. The Swiveling Sander swivels from a home position into a sanding position in order to add sand to a metal melting furnace at the same time as the slag plunger moves out of the way. After delivering sand, the swiveling sander swivels back to home position while the slag plunger also moves back to home position followed by the plunger clearing any slag.

8 Claims, 8 Drawing Sheets

SWIVELING SANDING SYSTEM

FIELD OF THE INVENTION

The present invention relates to a sander for delivering sand to a metal melting furnace and more specifically to a sander that swivels in and out of sanding position and a sander that swivels in and out of sanding position in coordination with a slag plunger.

BACKGROUND OF THE INVENTION

In metal melting furnaces, such as electric arc furnaces, molten metal may be tapped out through a tap hole or nozzle. The tap hole is filled with a refractory sand or sand-like material to first hold the molten metal in and then release it cleanly and quickly to facilitate molten metal flow. The repetitive metal melting and tapping process is known as tap to tap and the tap hole must be filled with sand after each tap. Sand may be dispensed directly from a bulk storage sand reservoir usually located near the furnace, for example, on a roof above the furnace, or on the floor. The sand dispensing process takes time and also causes heat loss from the furnace. Time may be lost dispensing increments of sand to properly fill a tap hole. A significant amount of sand may be wasted if sand is dispensed, unguided, into the furnace to accumulate adjacent but outside of the tap hole. An operator may inspect the tap hole to determine whether additional sand is required to properly fill the tap hole, or a camera may be used to visually inspect the tap hole during the sand filling cycle. There may be delays as an operator waits for a clear view of the tap hole, as dust settles after an incremental fill, to see whether additional sand must be dispensed to properly fill the tap hole. Alternatively, a tap hole may be filled with sand when there's still a layer of metal on top in which case the sand must sink into the tap hole and a visual inspection is not possible.

The sand may be guided with a chimney hole. U.S. Pat. No. 9,052,144 ("Kephart"), describes the use of a chimney hole as an unrestricted opening to fill sand into a tap hole in a steel making furnace with a remotely controlled plunger to clear metal flash and other formations which may plug or obstruct an access port. A remotely controlled plunger is preferable to an operator manually clearing an obstruction and being exposed to risk of injury while working in close proximity to a high temperature furnace. Kephart describes in FIG. 1 the eight steps of its automatic sand hopper before steelmaking heat may again be applied.

When a sand dispensing system is used, it needs to be put into position for sand dispersing, and the steps for dispensing sand are time consuming. It is desirable to have a sand dispensing system to deliver sand and clear slag that gets into position quickly to work effectively and efficiently to minimize down time and minimize wasting sand.

SUMMARY OF THE INVENTION

In an embodiment of the invention there is a swiveling sander for delivering sand through a hole in a metal melting furnace comprising a sand dispenser connected by a rotating arm to a platform capable of rotating which platform is connected to a rotating cylinder, wherein the sand dispenser moves in a horizontal arc from a home position to a sanding position over the hole for delivering sand and back again to a home position by the activation of the rotating cylinder. The horizontal arc may be from 0 degrees to 180 degrees, and may be substantially 90 degrees.

In a further embodiment of the invention, there is a swiveling sander with slag plunger for delivering sand through a hole in a metal melting furnace and clearing any slag comprising:

- a swiveling sander capable of moving in a horizontal arc from a home position to a sanding position over the hole for delivering sand and back again to a home position; and
- a slag plunger capable of moving in a vertical arc from a home position in which the slag plunger covers the hole and is capable of plunging through the hole and clearing any slag to a sanding position in which the slag plunger exposes the hole and back again to a home position;
- and wherein the moving of the swiveling sander and the moving of the slag plunger from a home position to a sanding position and back again to a home position is at the same time.

The horizontal arc may be from 0 degrees to 180 degrees and may be 90 degrees. The vertical arc may be from 70 to 110 degrees.

In a further embodiment of the invention there is a method of dispensing sand through a hole in a metal melting furnace and clearing any slag using a swiveling sander with slag plunger comprising:

- a swiveling sander capable of moving in a horizontal arc from a home position to a sanding position over the hole for delivering sand and back again to a home position; and
- a slag plunger capable of moving in a vertical arc from a home position in which the slag plunger covers the hole and is capable of plunging through the hole and clearing any slag to a sanding position in which the slag plunger exposes the hole and back again to a home position;
- and wherein the moving of the swiveling sander and the moving of the slag plunger from a home position to a sanding position and back again to a home position is at the same time.

BRIEF DESCRIPTION OF THE FIGURES

These and other aspects of the present invention will be apparent from the brief description of the drawings and the following detailed description in which.

DETAILED DESCRIPTION OF THE INVENTION

Figure 1:
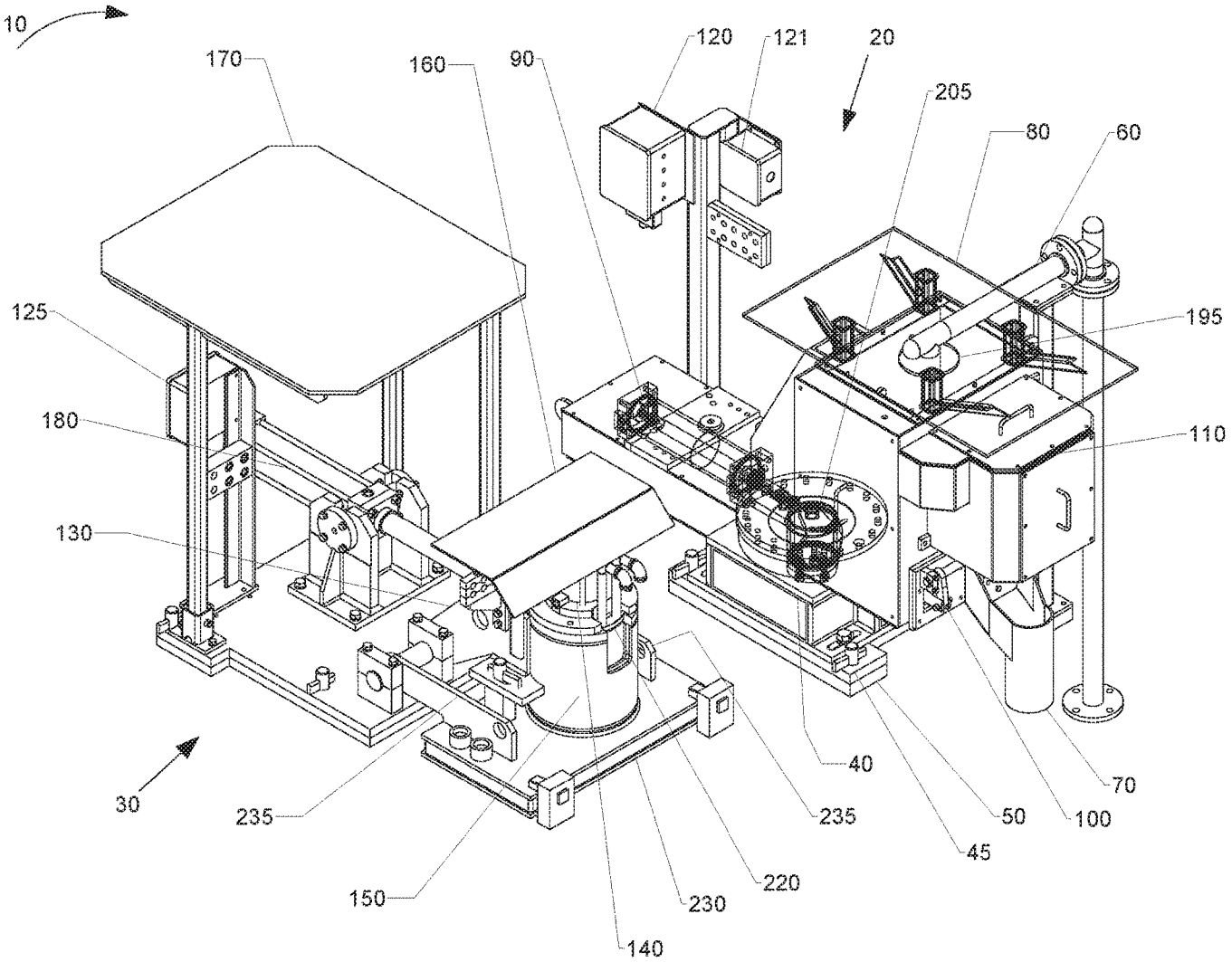
FIG. 1 is a right front perspective view of an embodiment of a Swiveling Sander with Slag Plunger of the present invention in home position in which the Swiveling Sander is shown with partial transparency.

In an embodiment of the invention there is a Swiveling Sander with a sand dispenser which swivels to deliver sand into a tap hole in a metal melting furnace. The arc of the lateral swiveling motion can be adjusted depending on the position of the sander relative to the opening in the furnace above the tap hole, for example, 45, 90, 120, 180 or 210 degrees. In the embodiment shown in the figures the swiveling motion is about 90 degrees.

In an embodiment of the invention there is a swiveling sander for delivering sand through a hole in a metal melting furnace comprising a sand dispenser connected by a rotating arm to a platform capable of rotating which platform is connected to a rotating cylinder, wherein the sand dispenser moves in a horizontal arc from a home position to a sanding position over the hole for delivering sand and back again to a home position by the activation of the rotating cylinder.

The horizontal arc may be from 0 degrees to 180 degrees, and may be substantially 90 degrees. In a further embodiment of the invention, there is a swiveling sander with slag plunger for delivering sand through a hole in a metal melting furnace and clearing any slag comprising:

- a swiveling sander capable of moving in a horizontal arc from a home position to a sanding position over the hole for delivering sand and back again to a home position; and
- a slag plunger capable of moving in a vertical arc from a home position in which the slag plunger covers the hole and is capable of plunging through the hole and clearing any slag to a sanding position in which the slag plunger exposes the hole and back again to a home position;
- and wherein the moving of the swiveling sander and the moving of the slag plunger from a home position to a sanding position and back again to a home position is at the same time.

The horizontal arc may be from 0 degrees to 180 degrees and may be 90 degrees. The vertical arc may be from 70 to 110 degrees.

In a further embodiment of the invention there is a method of dispensing sand through a hole in a metal melting furnace and clearing any slag using a swiveling sander with slag plunger comprising:

- a swiveling sander capable of moving in a horizontal arc from a home position to a sanding position over the hole for delivering sand and back again to a home position; and
- a slag plunger capable of moving in a vertical arc from a home position in which the slag plunger covers the hole and is capable of plunging through the hole and clearing any slag to a sanding position in which the slag plunger exposes the hole and back again to a home position;
- and wherein the moving of the swiveling sander and the moving of the slag plunger from a home position to a sanding position and back again to a home position is at the same time.

In the Swiveling Sander with Slag Plunger 10 of the present invention there is a Swiveling Sander 20 which swivels from a home position into a sanding position in order to add sand to a metal melting furnace at the same time as a Slag Plunger 30 moves out of the way. The Swiveling Sander 20 then swivels back to home position while the Slag Plunger 30 moves back to home position to clear any build up of slag. The working components of the Swiveling Sander 20 are preferably in boxes to keep sand from interfering.

A Swiveling Sander with Slag Plunger 10 is shown in home position in an embodiment of the invention at FIGS. 1-4, in which the Swiveling Sander 20 is apart from the Slag Plunger 30. The Swiveling Sander 20 comprises a means of delivering and storing sand or a sand substance, and in this embodiment the sand is delivered through a Sand Delivery Pipe 60 into a Dispenser 195 under which is a Dispenser Gate 100 which when opened releases sand out through a Sand Guiding Pipe 70. The Dispenser 195 may be further comprised of a measuring hopper. A Sander Shield 80 may be used to cover the Dispenser 195 to keep down dust and keep out contaminants. In this embodiment the Sand Delivery Pipe 60 is shown as a vertical pipe leading into a horizontal pipe for delivering the sand through blowing it up through the Sand Delivery Pipe 60 but other configurations may be used such as a bulk hopper above the Dispenser 195 for free fall of the sand. In this embodiment there is a junction post 120 for controlling and powering the hydraulic, pneumatic and electrical to the Swiveling Sander 20 and junction box 125 for the Slag Plunger 30, as well as a camera and ethernet connection box 121.

Figure 2:
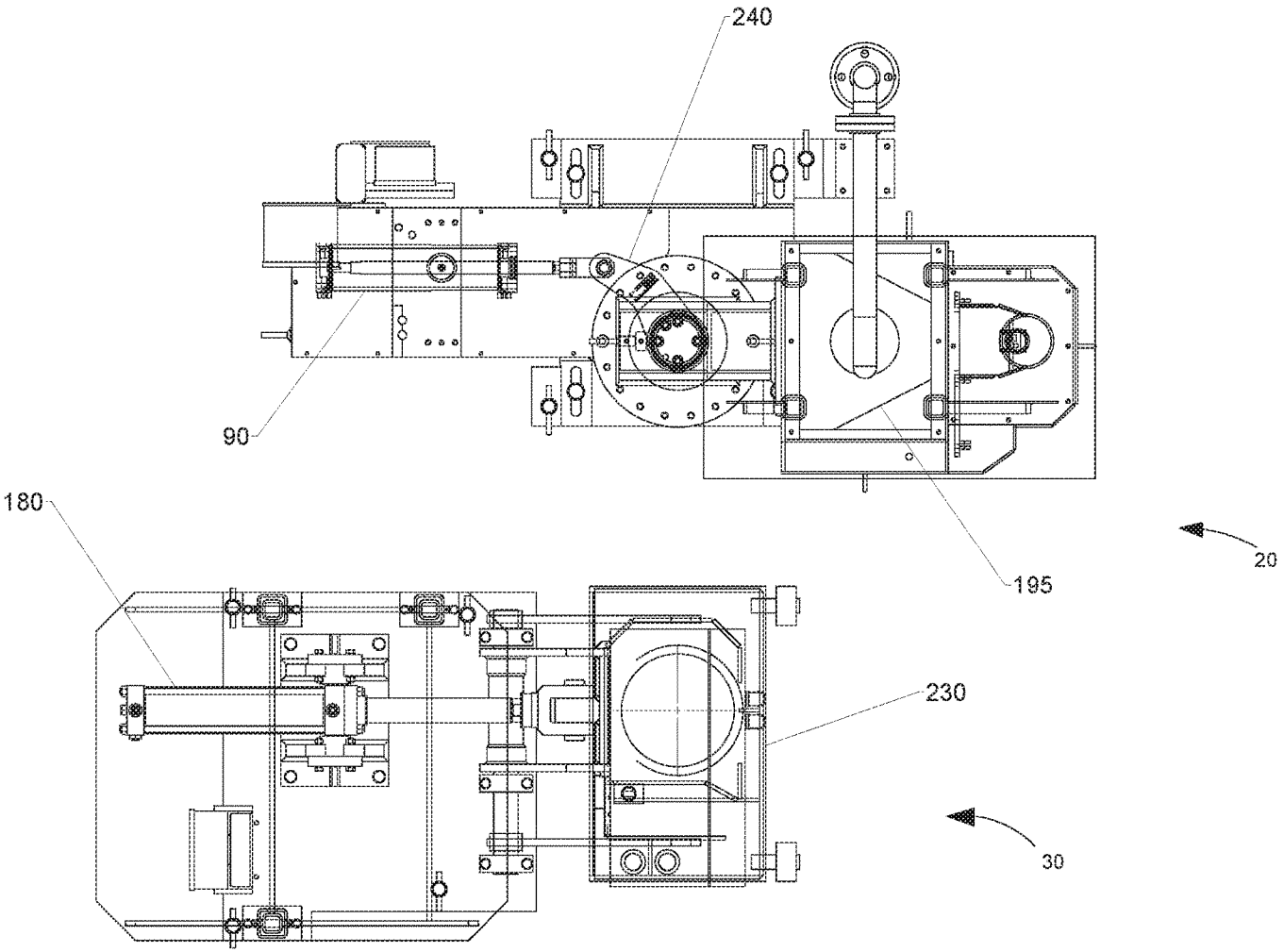
FIG. 2 is a top view of the Swiveling Sander with Slag Plunger of FIG. 1, shown without a swiveling sander shield and without a first plunger shield and its supports.
Figure 3:
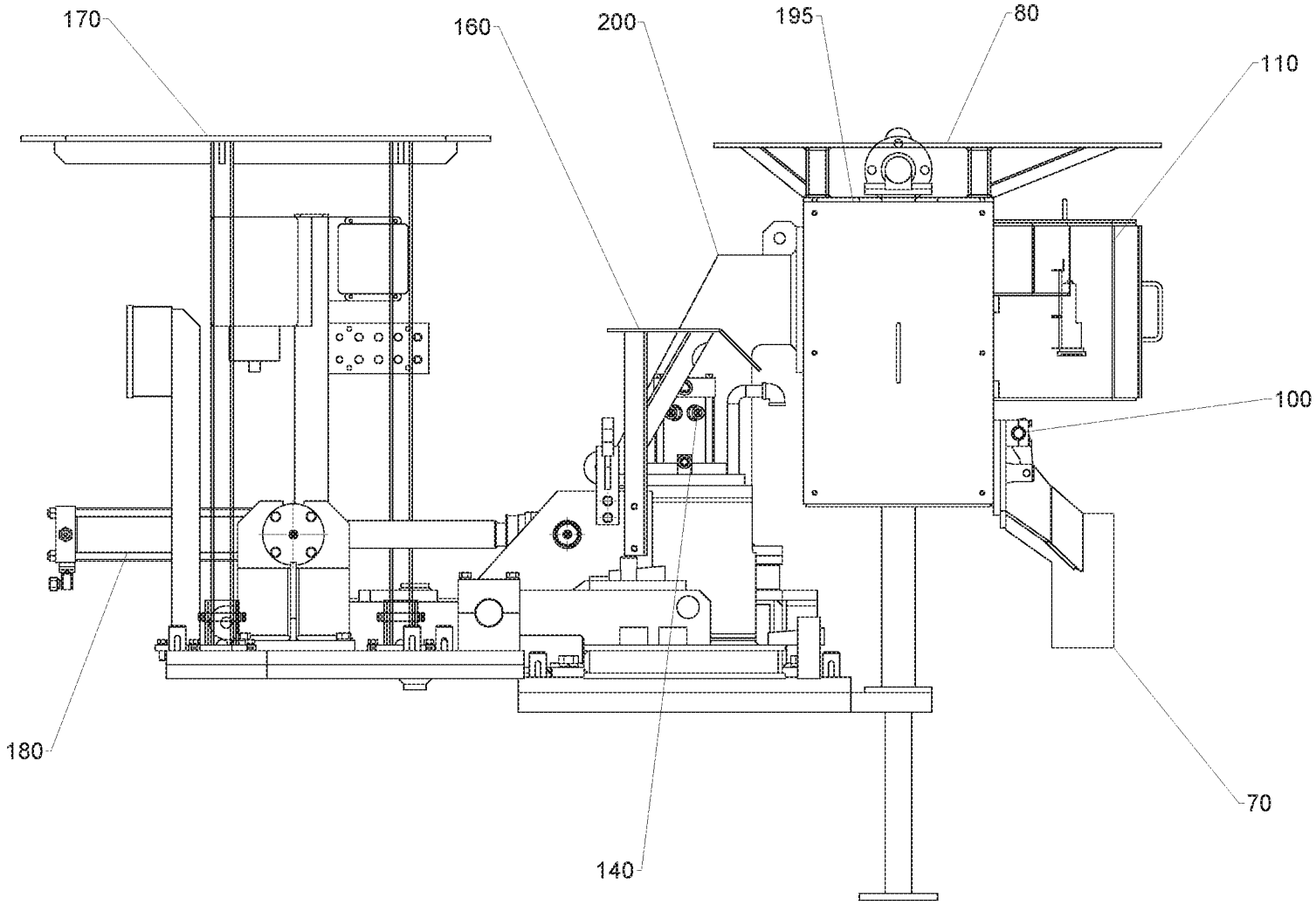
FIG. 3 is a right-side view of the Swiveling Sander with Slag Plunger of FIG. 2.
Figure 4:
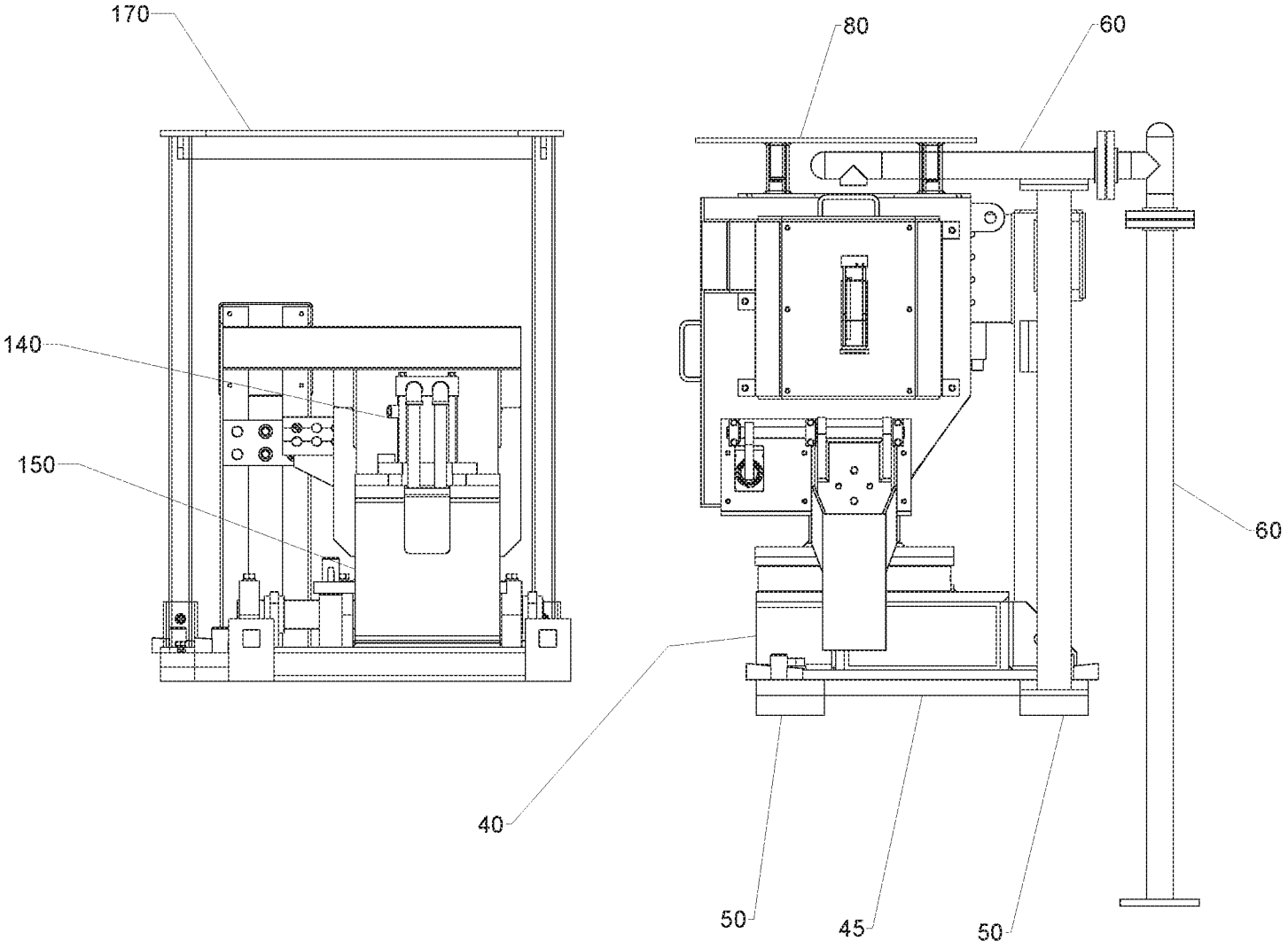
FIG. 4 is a front view of the Swiveling Sander with Slag Plunger of FIG. 2.
Figure 6:
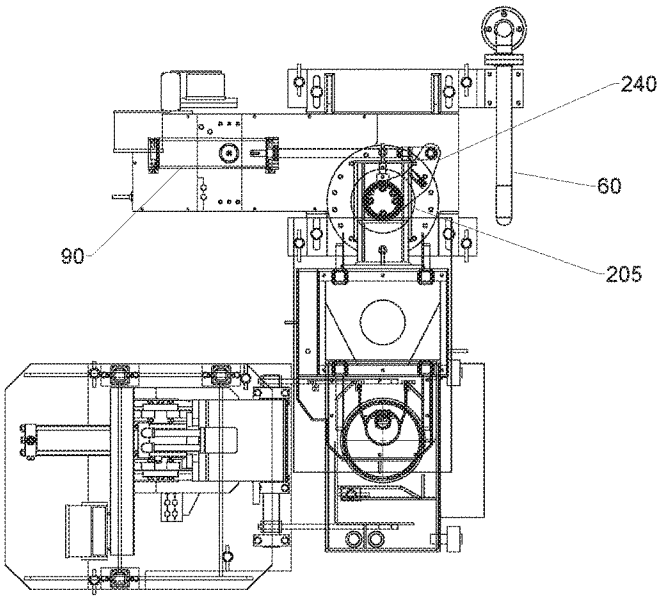
FIG. 6 is a top view of the Swiveling Sander with Slag Plunger of FIG. 5, shown without a swiveling sander shield and without a first plunger shield and its supports.
Figure 8:
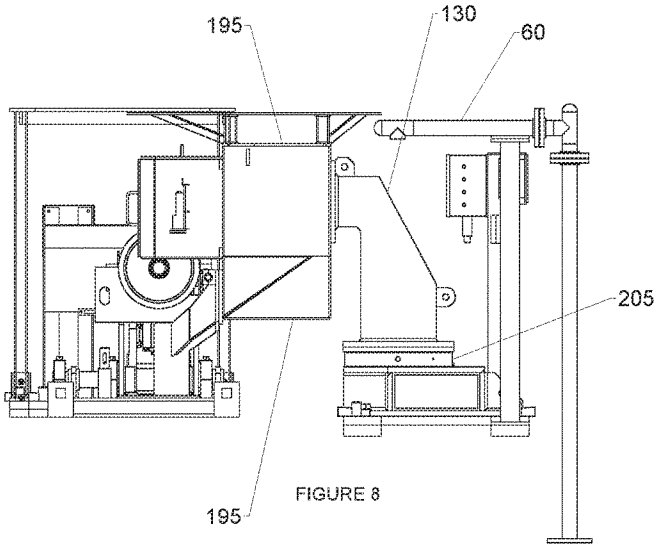
FIG. 8 is a front view of the Swiveling Sander with Slag Plunger of FIG. 5.
Figure 7:
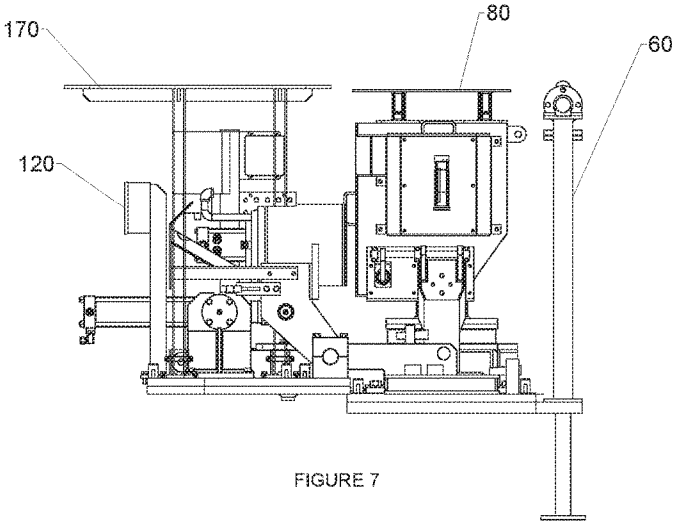
FIG. 7 is a right-side view of the Swiveling Sander with Slag Plunger of FIG. 5.

In this embodiment the Swiveling Sander 20 is resting on a base plate 45 which is resting on base plate pads 50. A Sander Rotating Cylinder 90 resting on a Base 40 is used to swivel the Swiveling Sander 20. In FIGS. 1, 2 and 6 there are transparencies in order to demonstrate an embodiment of the invention. FIG. 8 shows a Swivel Platform 205 also rests on the Base 40 and is capable of rotating in relation to the Base 40. FIG. 8 shows a Rotating Arm 200 attached to the Swivel Platform 205 at a first end and to the Dispenser 195 at a second end. The Dispenser 195 preferably has a Camera Housing 110 for storing a camera to determine that sand has filled a tap hole (shown in FIGS. 9 and 10). A water-cooled camera may be used. The camera is connected to a computer monitor to show the size of the tap hole on the monitor and determine how much sand should be delivered to the tap hole to fill it.

Figure 5:
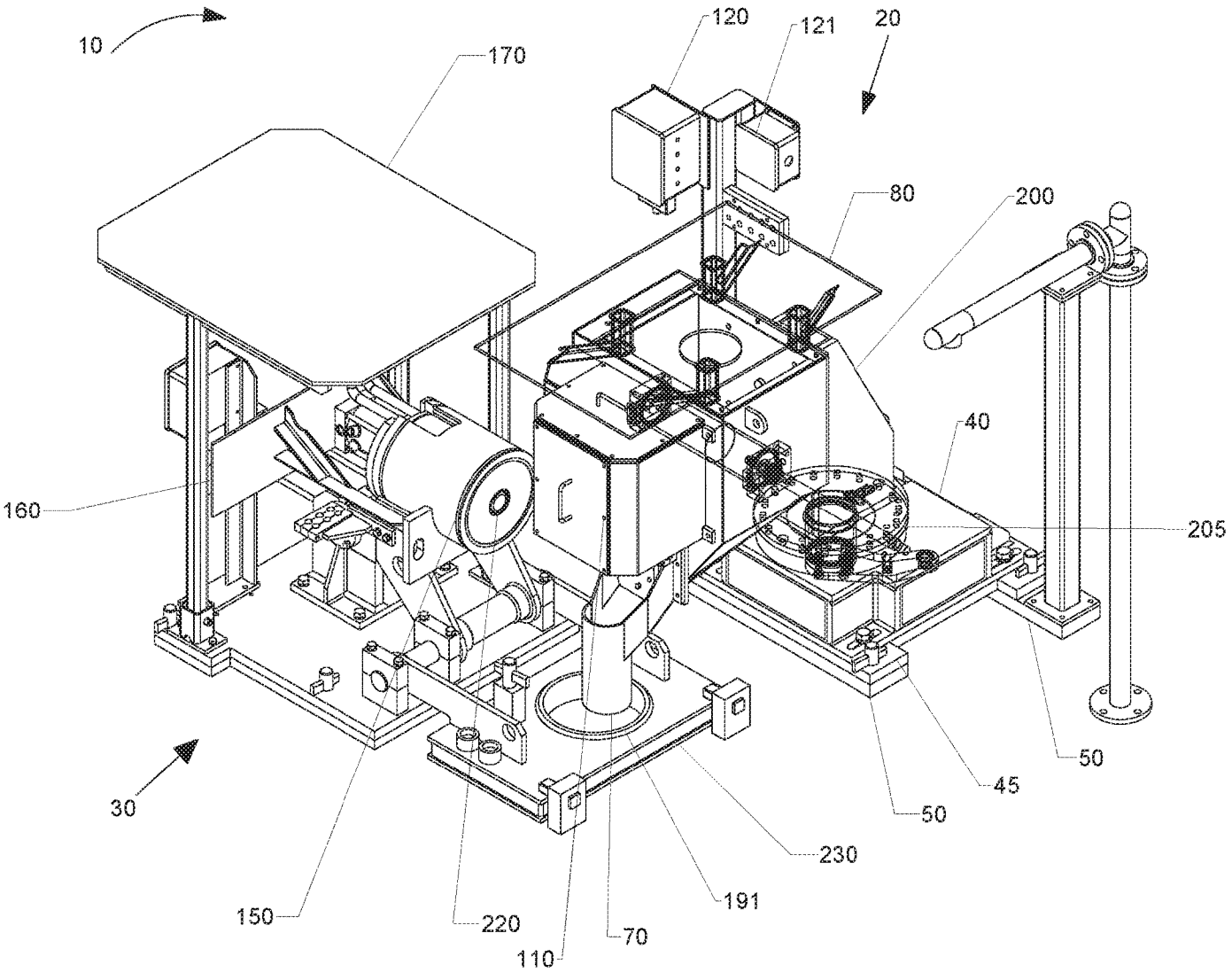
FIG. 5 is a right front perspective view of an embodiment of a Swiveling Sander with Slag Plunger of the present invention in sanding position.

FIGS. 1-4 also shows the Slag Plunger 30 in a home position with a First Plunger Shield 160 to protect the plunger portion. A Second Plunger Shield 170 to protect the cylinder portion is shown in FIG. 1 but the Second Plunger Shield 170 and its supports are not shown in FIGS. 2 and 6 in order to demonstrate an embodiment of the invention. The plunger portion comprises a Plunger Cylinder 140 attached to a Plunger Arm 130 attached to a Plunger Housing 150 within which there is a plunger head 220 as shown in FIG. 5.

The home position shown in FIGS. 1-4 is also the position just before the Slag Plunger 30 is activated to clear slag.

In this embodiment, in operation the Dispenser 195 swivels about 90 degrees when the Sander Rotating Cylinder 90 rotates the Swivel Platform 205 which moves the Rotating Arm 200. The swivel movement could be varied particularly depending on the location of the Swiveling Sander 20, for example, it could follow an arc from 0 to 180 degrees. At the same time as the Swiveling Sander is moving, the Plunger Housing Cylinder 180 retracts to pull the Plunger Arm 130 up and expose a Sump Panel Door Opening 191 in the Panel Door 230 as seen in FIGS. 5 to 8. The Swiveling Sander 20 stops swiveling when the Sand Guiding Pipe 70 is above the Sump Panel Door Opening 191 in the Sump Panel Door 230. The Dispenser Gate 100 opens to allow the sand in the Dispenser 195 to fall through the Sand Guiding Pipe 70. In sanding position, the Dispenser 195 is facing toward and between the Sander Rotating Cylinder 90 and the Plunger Cylinder 180, whereas in the home position, the Dispenser 195 is facing towards the Sump Panel Door 230.

After releasing the sand, the Dispenser Gate 100 closes and the Sander Rotating Cylinder 90 turns the other way to return the Swiveling Sander 20 to the home position. The Plunger Housing Cylinder 180 also returns the Plunger Housing 150 back over the Sump Panel Door Opening 191.

In addition, a Plunger Cylinder 140 pushes the Plunger Head 220 through the Sump Panel Door Opening 191 to push through any slug build up and then the Plunger Head 220 returns to home position.

The Swiveling Sander with Slag Plunger 10 of the present invention may be installed with existing furnaces or with new installations and it will be understood that the scale of the Swiveling Sander with Slag Plunger 10 should match the scale of the furnace and/or the sanding volume to be delivered.

The Swiveling Sander 20 may be installed on the sump panel or on the sump panel platform and the Slag Plunger 30 may be installed on the Sump Panel or on the sump panel platform. The Swiveling Sander is at the level at which it will be capable of swiveling the Sand Guiding Pipe 70 over the Sump Panel Door Opening 191.

Figure 9:
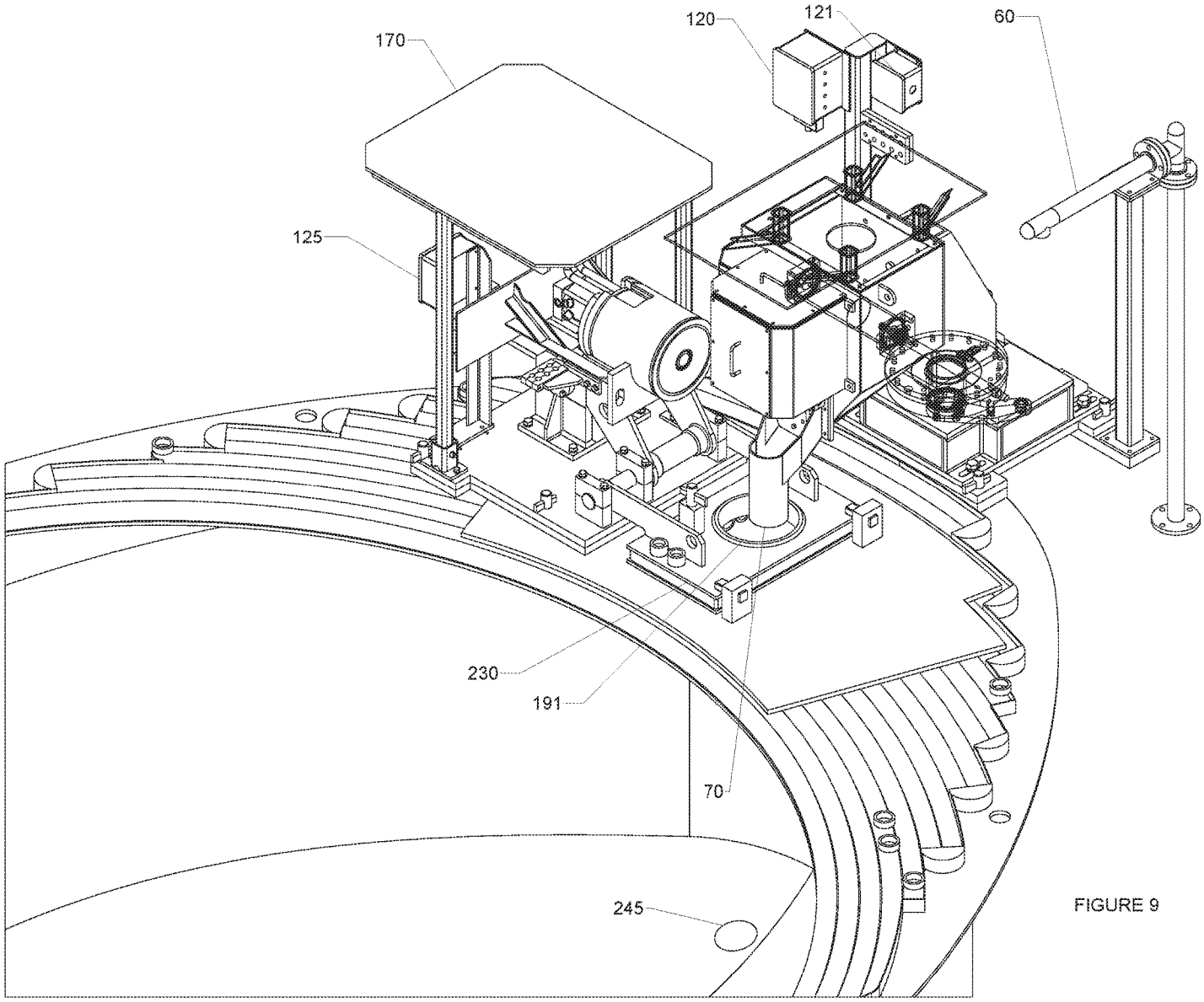
FIG. 9 is a right-side perspective view of the Swiveling Sander with Slag Plunger of FIG. 5 on a sump panel and sump panel platform.
Figure 10:
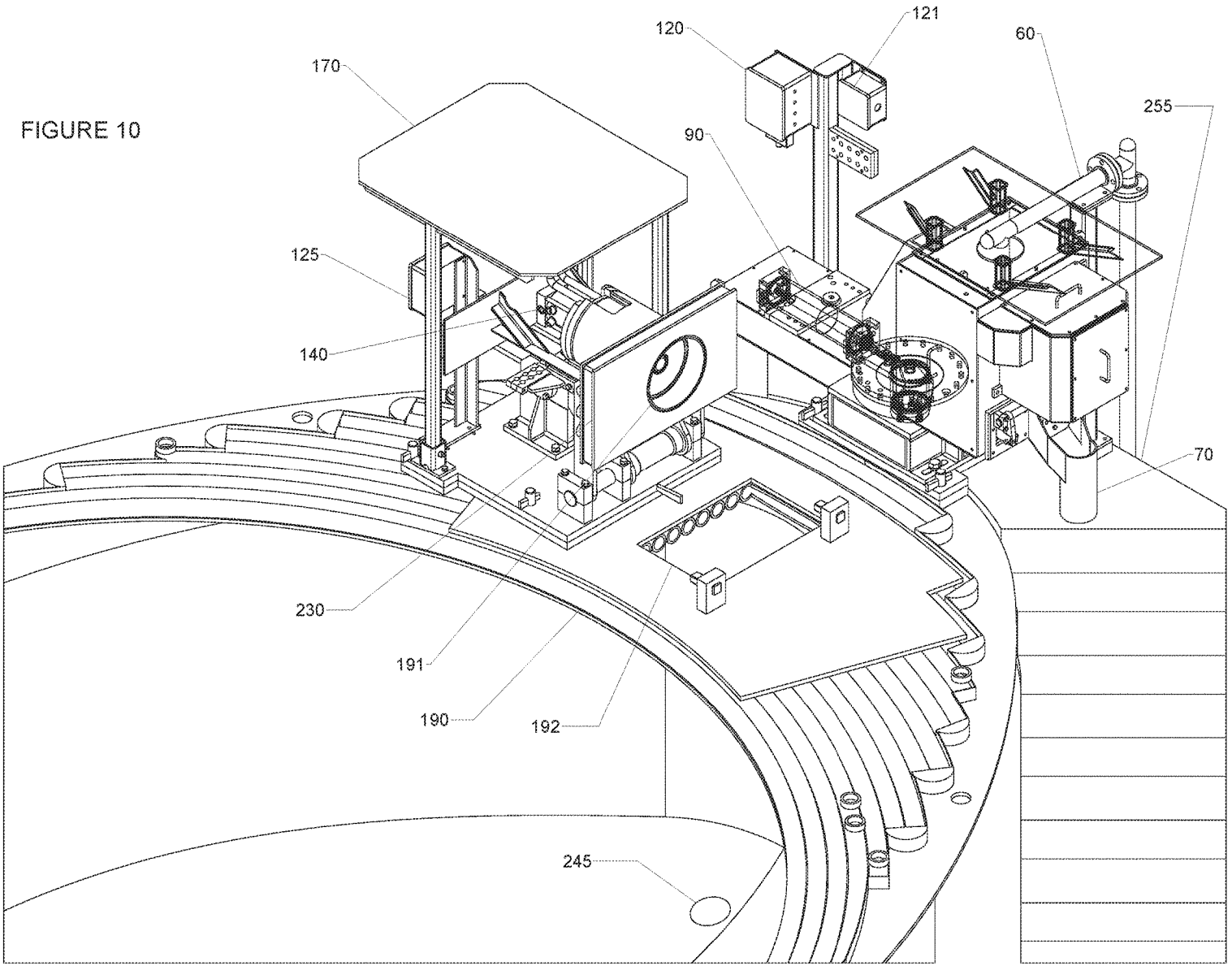
FIG. 10 is a right-side perspective view of the Swiveling Sander with Slag Plunger on a sump panel and sump panel platform in maintenance position.

FIGS. 9 and 10 show the Slag Plunger on a Sump Panel 190 through which there is a sump panel opening 192. Also shown is the tap hole 245 which is under the sump panel opening 192. FIG. 10 shows the Slag Plunger 30 in maintenance position in which not just the Plunger Housing 150 but also the Sump Panel Door 230 is raised by the Panel Door Arms 235 through use of a manual locking pin (not shown).

While embodiments of the invention have been described in the detailed description, the scope of the claims should not be limited by the preferred embodiments set forth in the examples but should be given the broadest interpretation consistent with the description as a whole.

What is claimed is:

1. A method of dispensing sand through a hole in a metal melting furnace and clearing any slag using a swiveling sander with a slag plunger, the method comprising the steps of: moving a swiveling sander in a horizontal arc from a home position to a sanding position over the hole for delivering sand and back again to a home position, wherein the swiveling sander is connected to a rotating cylinder; and moving a slag plunger in a vertical arc from a home position, in which the slag plunger covers the hole and is capable of plunging through the hole and clearing any slag, to the sanding position, in which the slag plunger exposes the hole, and back again to a home position; wherein the moving of the swiveling sander and the moving of the slag plunger from a home position to a sanding position and back again to the home position is at the same time.

2. A swiveling sander for delivering sand through a hole in a metal melting furnace, the swiveling sander comprising:

a sand dispenser connected to a platform by a rotating arm; and a rotating cylinder connected to the platform; and a slag plunger configured to move between a home position in which the slag plunger is positioned over and covers the hole and a sanding position in which the slag plunger uncovers the hole, wherein the sand dispenser is configured to move in a horizontal arc from a home position to a sanding position over the hole for delivering sand and back again to a home position by the activation of the rotating cylinder, and wherein the movement of the sand dispenser and slag plunger occurs at the same time.

3. The swiveling sander of claim 2, in which the horizontal arc is from 0 degrees to 180 degrees.

4. The swiveling sander of claim 2, in which the horizontal arc is substantially 90 degrees.

5. A swiveling sander with slag plunger for delivering sand through a hole in a metal melting furnace and clearing any slag comprising:

a swiveling sander connected to a rotating cylinder and configured to move in a horizontal arc from a home position to a sanding position over the hole for delivering sand and back again to a home position; and a slag plunger capable of moving in a vertical arc from a home position in which the slag plunger covers the hole and is capable of plunging through the hole and clearing any slag to the sanding position in which the slag plunger exposes the hole and back again to a home position;

and wherein the moving of the swiveling sander and the moving of the slag plunger from a home position to a sanding position and back again to the home position is at the same time.

6. The swiveling sander with slag plunger of claim 5, in which the horizontal arc is from 0 degrees to 180 degrees.

7. The swiveling sander with slag plunger of claim 6, in which the horizontal arc is 90 degrees.

8. The swiveling sander with slag plunger of claim 6, in which the vertical arc is from 70 to 110 degrees.

* * * * *